US006060668A

United States Patent [19]

Azzola et al.

[11] Patent Number: 6,060,668

[45] **Date of Patent: *May 9, 2000**

[54] SET OF SWITCHES WITH MEANS OF MUTUAL LOCKING

[75] Inventors: Lucio Azzola; Gustavo Brignoli, both of Bergamo, Italy

[73] Assignee: ABB Sace L.V. S.p.A., Bergamo, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/993,042

[22] Filed: Dec. 18, 1997

[30] Foreign Application Priority Data

Dec. 20, 1996 [IT] Italy ..... MI96A2686 U

[51] Int. Cl.[7] ..... H01H 9/26

[52] U.S. Cl. ..... 200/5 B; 200/1 R; 200/17 R; 200/50.33

[58] Field of Search ..... 200/1 R, 5 B, 200/5 C, 17 R, 18, 1 A, 1 B, 50.01, 50.32, 50.33, 50.37, 537, 538, 543, 545, 546, 318, 320, 321, 322, 331, 337

[56] References Cited

U.S. PATENT DOCUMENTS

| | | | |
|---|---|---|---|
| 2,904,649 | 9/1959 | Ranson | 200/50 |
| 5,466,902 | 11/1995 | Blom et al. | 200/50 AA |
| 5,726,401 | 3/1998 | Green et al. | 200/50.33 |
| 5,814,777 | 9/1998 | Green et al. | 200/50.33 |

*Primary Examiner*—Michael Friedhofer
*Attorney, Agent, or Firm*—Guido Modiano; Albert Josif; Daniel J. O'Byrne

[57] ABSTRACT

Set of switches mutual locking devices, comprising switches with actuator toggles and locking elements, each of the switches having a rocker supported by an elastic element and having Bowden type cables to be connected to the two arms of the rockers, the free end of a first cable of a switch being operationally connected to elements of actuation of a second switch and the free end of a second cable being operationally connected to the elements of actuation of a third switch, and the rockers being loaded at their ends to come into operational contact with the locking elements.

13 Claims, 5 Drawing Sheets

SET OF SWITCHES WITH MEANS OF MUTUAL LOCKING

BACKGROUND OF THE INVENTION

The invention relates to a set of switches with means of mutual locking comprising three switches, where each switch has actuation means connected via cables with locking means.

Known means of actuation stretch the cables when passing from the switch open position to the switch closed position. Known means of locking, actuated by the cables, prevent closure of the switch.

It is known that in an electrical plant consisting of two separately fed systems of bars, one switch is inserted into each system of bars. A third switch is inserted into a system of bars for linking the first two systems, and is normally open. In the event that one of the feeds fails, the switch, which connects this feed to the system of bars of the electrical plant, opens and the third switch, which connects the two systems of bars (or linking switch), closes connecting the remaining active feed to both systems of bars.

The device for mechanically interlocking the three switches guarantees that the two feeds are not inadvertently connected together when they are both active and connected to the electrical plant.

At present mechanical interlocking between three switches is carried out by connecting to known means of locking of known mechanisms. These mechanisms, present on each of the switches, are connected by first movable parts to the known means of actuation of the other switches via known flexible cables. Second movable parts of the mechanisms are connected to the known means of locking of the switch.

The first movable parts, usually consisting of slides, guided for example by pins running in suitable slots, transmit the motion imposed by the actuation means to the second movable parts. This transmission takes place by virtue of guide channels. Channels made between the first movable parts. The geometries of these guide channels can be altered with the relative position of the movable parts.

Only in the case in which two of the switches are simultaneously closed, these first movable parts, connected to them, restrict the guide channels in a manner appropriate for anchoring and dragging the second movable parts. In their turn these second movable parts transmit the motion to the switch locking mechanisms.

These mechanisms are bulky, complex and made up of a large number of components. In particular these mechanisms are sensitive to the correct magnitude of the dimensional tolerance of the various parts for effecting functioning.

Additionally, correct mounting of the components of the mechanism on the switch considerably influences functioning.

SUMMARY OF THE INVENTION

The objective of the present invention is to overcome the above-listed drawbacks of the prior art and to simplify and strengthen the construction of the device, by guaranteeing high reliability and free arrangement of the switches to be mutually locked.

The objectives of the invention are achieved by means of a set of switches with means of mutual locking, comprising a first, a second and a third switch in which each of the switches has actuation means connected via cables to locking means, characterized in that each switch has an elastically supported rocker, in that each rocker is operationally connected to a means of locking the corresponding switch, in that each switch has an actuation means connected to two ends of two cables, in that the free ends of the cables of the first switch extend to an arm of the rocker of the second switch and to the arm of the rocker of the third switch, in that the free ends of the cables of the second switch extend to the arm of the rocker of the first switch and to the arm of the rocker of the third switch, and in that the free ends of the cables of the third switch extend to the arm of the rocker of the second switch and to the arm of the rocker of the first switch.

Advantageously the rockers are connected centrally to a spring fixed to the switch at the opposite end.

With further advantage the actuation means of each switch are in operational connection with slides translating from the switch open position to the switch closed position and the translating slides are connected to Bowden type cables.

To enable the rocker to interact with the toggles of the locking means, the levers of the rockers are inserted freely into slots for access to the toggles of the locking means provided in the support plates.

Advantageously the lever of the rockers has grooves in its terminal part.

With further advantage the terminal part has inclined lips.

In order to connect the Bowden cables to the rockers, holes are provided at the end of the arms of the rockers.

For the purpose of connecting the means of elastic suspension to the rocker in such a way as to hold the arms of the rockers horizontal, the rockers have central holes to which the spring is connected.

To enable the translating Bowden cables to make the lever of the rockers run effortlessly in the slots present in the support plate, the Bowden cables connected to the arms of the rockers are arranged parallel to the slot for access to the toggles of the locking means.

To guarantee a free arrangement in the electrical board of the three switches to be mutually locked, the cables are flexible and run in sheaths and have threaded terminals at their ends.

To adjust the length of the cables which connect the actuation means with the locking means, the threaded terminals of the cables are screwed with adjustment to the arms of the rockers by means of clasps fixed to threaded nuts.

Advantageously the translating slides have a projection into which threaded terminals fixed to the ends of the cables are screwed with adjustment.

To prevent the sheaths in which the cables run from moving during the tensioning of the cables and to facilitate the motion of the translating slide, projections of the support plate to which are connected sheaths in which the cables run are provided opposite the translating slides and the cables are arranged parallel to the direction of run of the translating slides.

The advantage of the present invention is to be perceived mainly in considerable constructional simplicity.

A further advantage is inferable from the small number of components and from the easy mounting which brings about high robustness and extreme reliability, also because no special geometrical tolerance is required in the construction of the components and in the mutual arrangement during mounting.

An advantage consists in the limited dimensions and ease of adjustment.

A further advantage consists moreover in the possibility of a free arrangement of the switches to be mutually locked.

BRIEF DESCRIPTION OF THE DRAWINGS

The subject, devised according to the present invention, will be described below in greater detail and illustrated as an embodiment, given merely by way of example, in the appended drawings in which.

DESCRIPTION OF THE PREFERRED EMBODIMENTS

Switches with means of mutual locking are of known design and functioning, so that only the parts essential to the invention will be described below.

Figure 1:
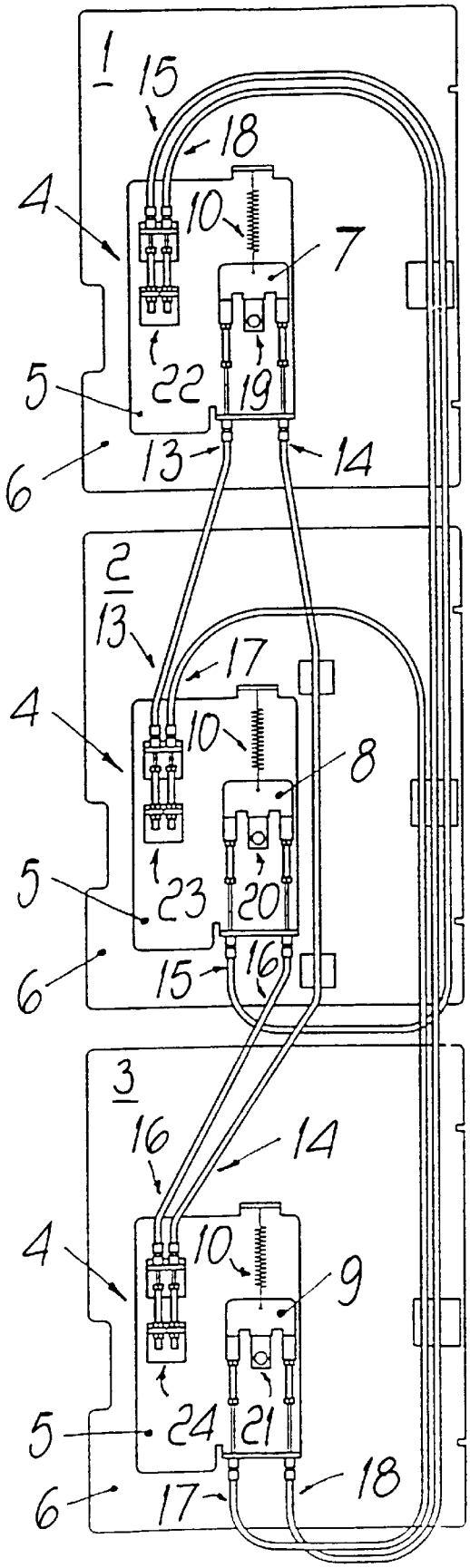
FIG. 1 illustrates, diagrammatically and in side view, three switches mutually connected by locking means.

From FIG. 1 may be observed a possible arrangement of three switches 1, 2, 3 having means of mutual locking, indicated 4 as a whole.

The devices 4 for mutual locking are present in a similar manner on each switch 1, 2, 3.

Therefore, the device 4 for locking the second switch 2 will be described below by way of example.

The switch 2 has a plate 5 fixed to a lateral abutment 6 of the box.

Parallel to the plate 5 there is a rocker 8 supported centrally and at the top at the lower end of a spring 10. The spring 10 is fixed, at the opposite end, to the plate 5.

The ends of two cables running in sheaths or Bowden cables, indicated 15 and 16 as a whole, are connected in a pivotable manner to the two arms of the rocker 8.

Toggles of a locking means, which is indicated 20 as a whole, are provided beneath the rocker 8 and between the ends of the two cables 15, 16. This means 20 of locking the control for opening and closing the switch 2 is not in contact with the rocker 8, in the arrangement illustrated.

A translating slide, indicated 23 as a whole, is also provided on the plate 5. This translating slide 23 is operationally connected with the toggles of an actuation means or indicator toggles placed in line with the translating slide 23 beneath the plate 5. For example, the translating slide 23 is connected to a lever fixed to the main shaft of the control mechanism of the switch 2.

The ends of two Bowden type cables, indicated 13 and 17 as a whole, are fixed to the translating slide 23.

The opposite end of the first cable 13 is connected to the rocker 7 of another switch, the first switch 1 in the arrangement illustrated.

The opposite end of the second cable 17 is connected to the rocker 9 of the third switch 3.

The cables 15, 18 connected to the translating slide 22 of the first switch 1 are connected, at the opposite end, in the case of the first cable 15, to the rocker 8 of the second switch 2 and in the case of the second cable 18 to the rocker 9, of the third switch 3.

Similarly the cables 14, 16, connected to the translating slide 24 of the third switch 3, have their opposite end connected, in the case of the first cable 14, to the rocker 8 of the second switch 2 and in the case of the second cable 16 to the rocker 7 of the first switch 1.

From FIGS. 2, 3, 4 and 5 it is possible to observe the constituent details of the device for mutual locking of the second switch 2 and, particularly, the constituent details of the rocker 8 and of the translating slide 23.

Figure 2:
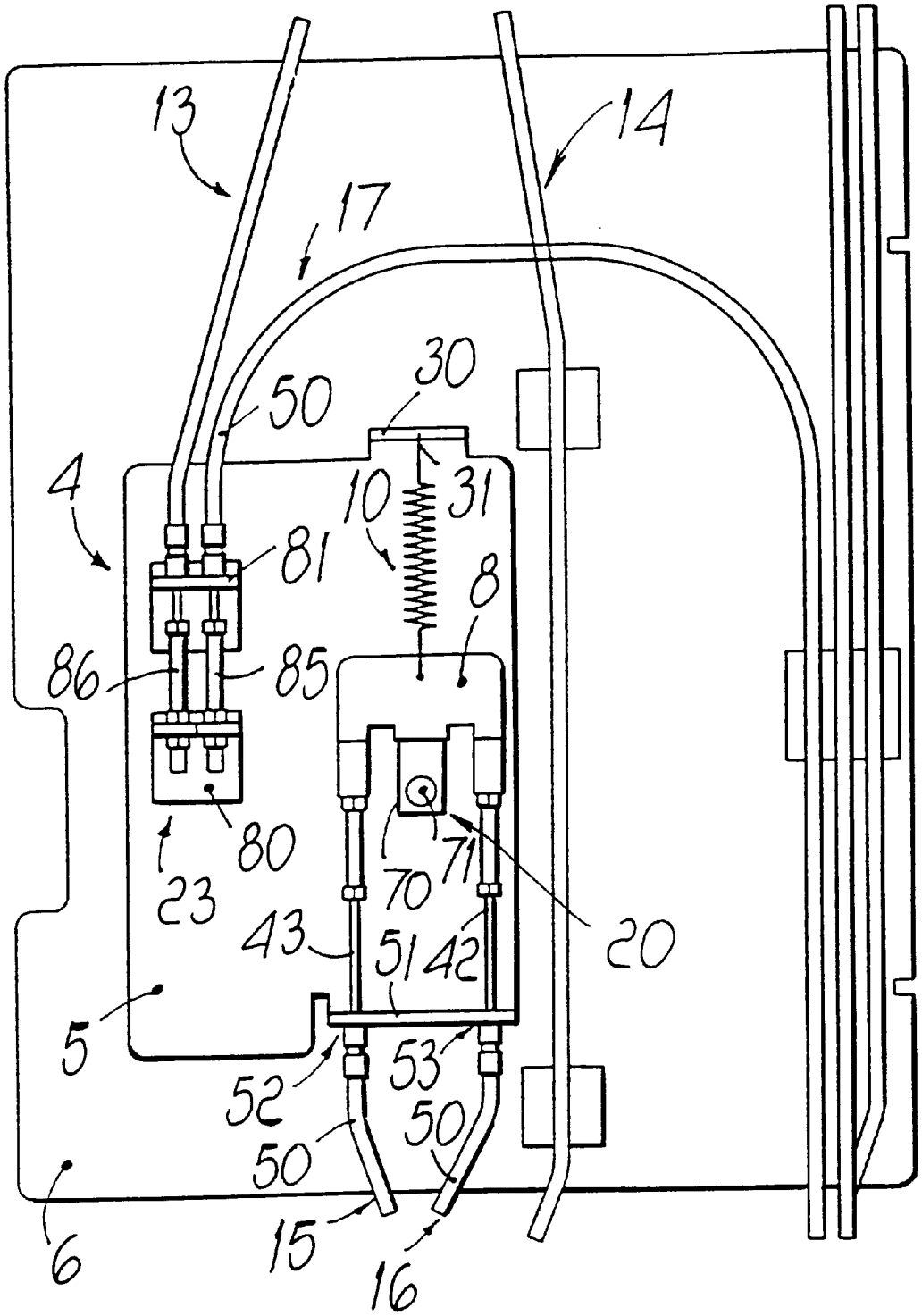
FIG. 2 shows the detail of the second switch of FIG. 1.

The spring 10 is connected at the top to the projection 30 present on the plate 5 (FIG. 2).

Advantageously, centrally to the projection 30 there is a hole in which the grommet 31 of the spring 10 is inserted.

Figure 3:
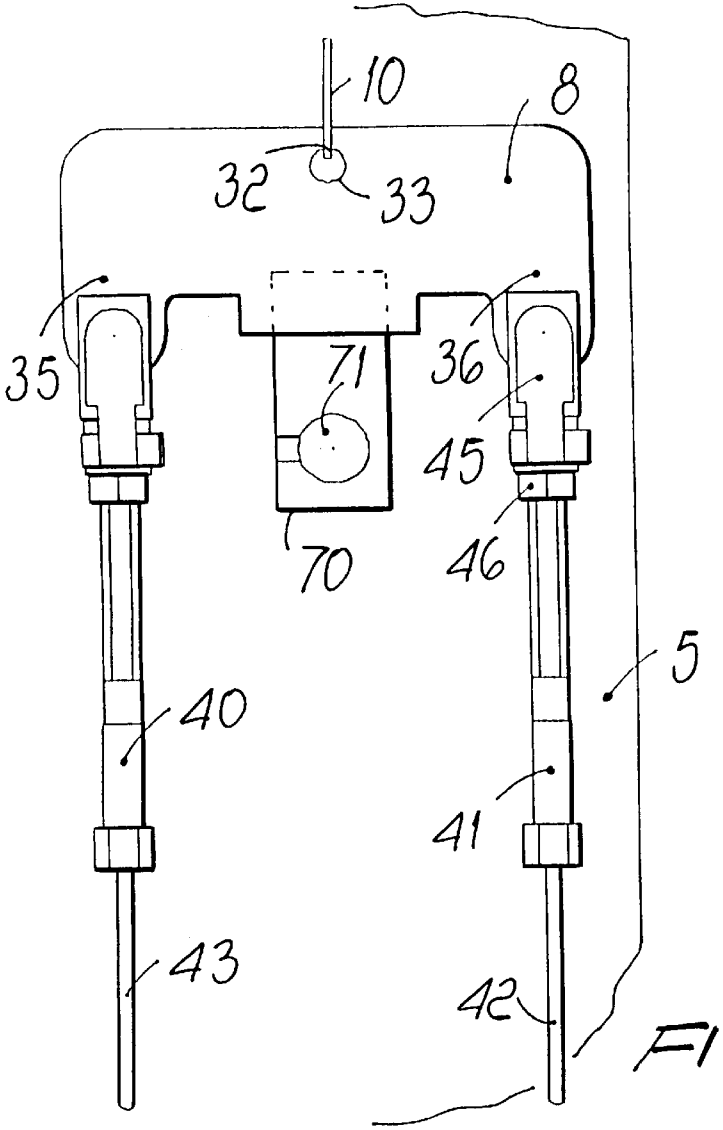
FIG. 3 illustrates the detail of a rocker mounted on a switch and not interacting with the toggles of the locking means.

The opposite end of the spring 10 is connected by means of a grommet 31 to a central hole 32 of the rocker 8 (FIG. 3).

Figure 4:
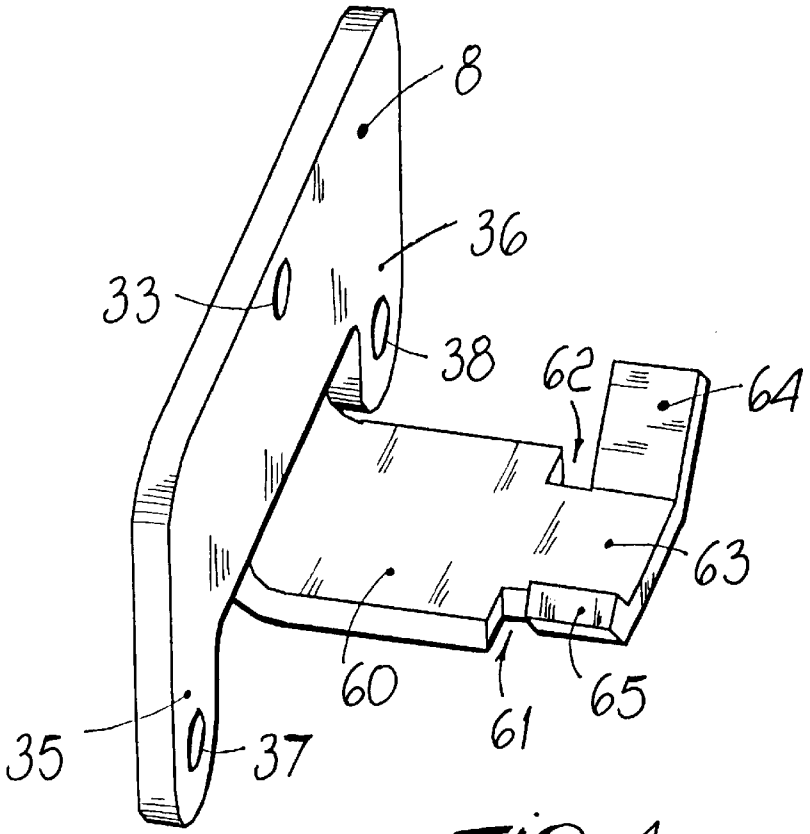
FIG. 4 illustrates the rocker of FIG. 3, seen from behind and axonometrically.

The lower end of the arms 35, 36 of the rocker 8 have holes 37, 38 (FIG. 4). The ends of the cables 42, 43 are lodged in these holes 37, 38.

Advantageously, threaded terminals 40, 41 fixed to the end of the cables 42, 43 are screwed into nuts 46 fixed to pins or grommets 45 inserted into the holes 37, 38 of the rocker 8.

The cables 42, 43 are inserted so that they can run in sheaths 50 fixed at the end to a projection 51 provided on the plate 5 (FIG. 2).

Advantageously the housings 52, 53 for the fixing of the sheaths 50, are arranged on the projection 51 in such a way that the distance between the cables 42, 43 coincides with the width of the rocker 8. The housings 52, 53 are moreover arranged in such a way that the cables 42, 43 are parallel and vertical.

In the central and lower part the rocker 8 has a lever 60 orthogonal to the plane of the rocker 8 (FIG. 4). Two grooves 61, 62 are present laterally at the end of the lever 60. The terminal part 63 of the lever 60 has upwardly inclined lateral lips 64, 65.

Figures 7, 8, 9:
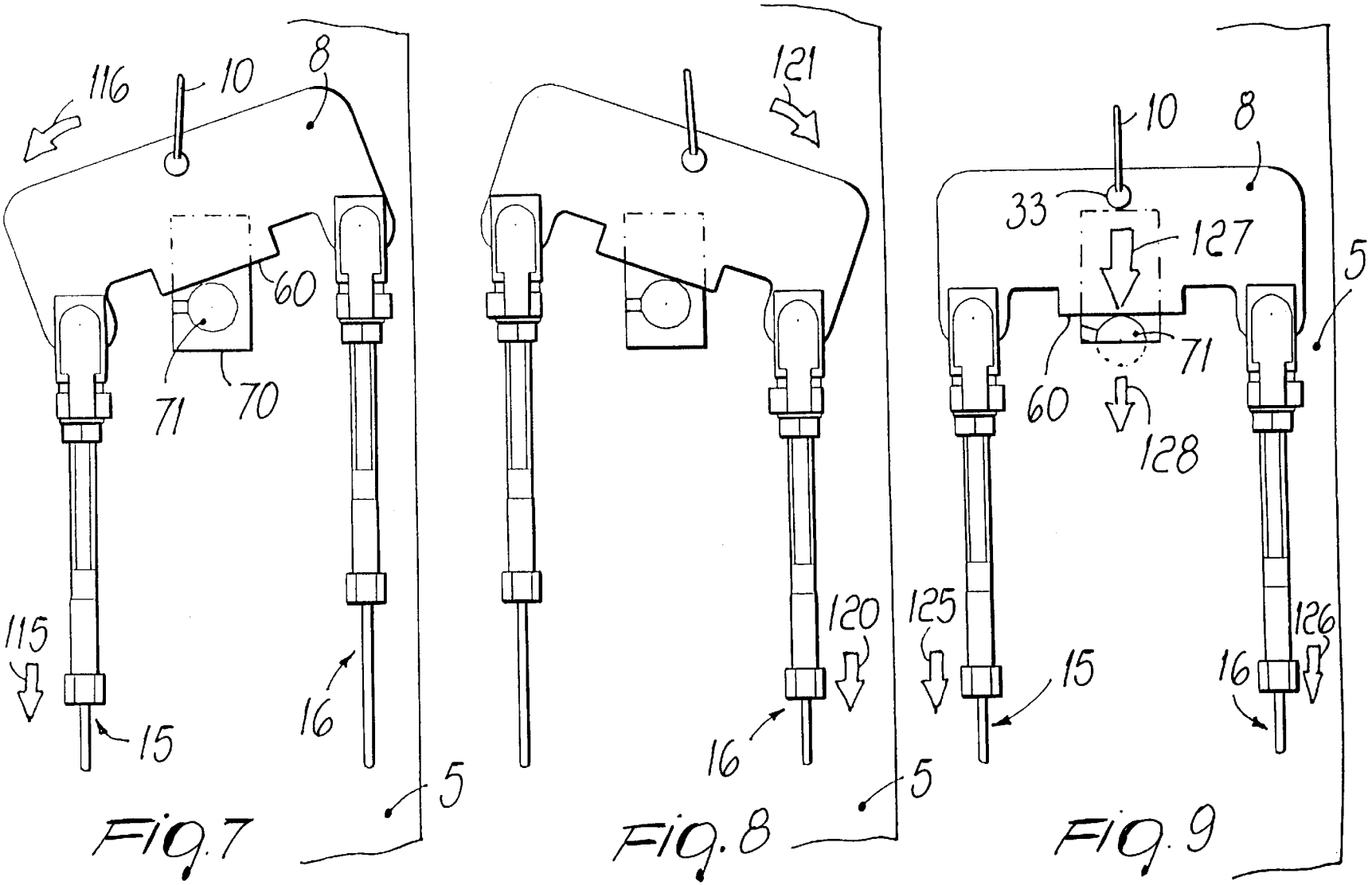
FIGS. 7 and 8 illustrate two different positions of the rocker.
FIG. 9 illustrates a third position of the rocker in contact with the toggles of the locking means.

In line with the grooves 61, 62 the rocker 8 is inserted, without contact, into a vertical slot 60 made in the plate 5 (FIG. 2 and 3). The slot 70 is long enough to allow the rocker 8, when it is arranged in the lower part of the slot 70, to bear with thrust by means of the lever 60 on the toggles 71 of the means of locking of the switch 2 (FIG. 9).

Figure 5:
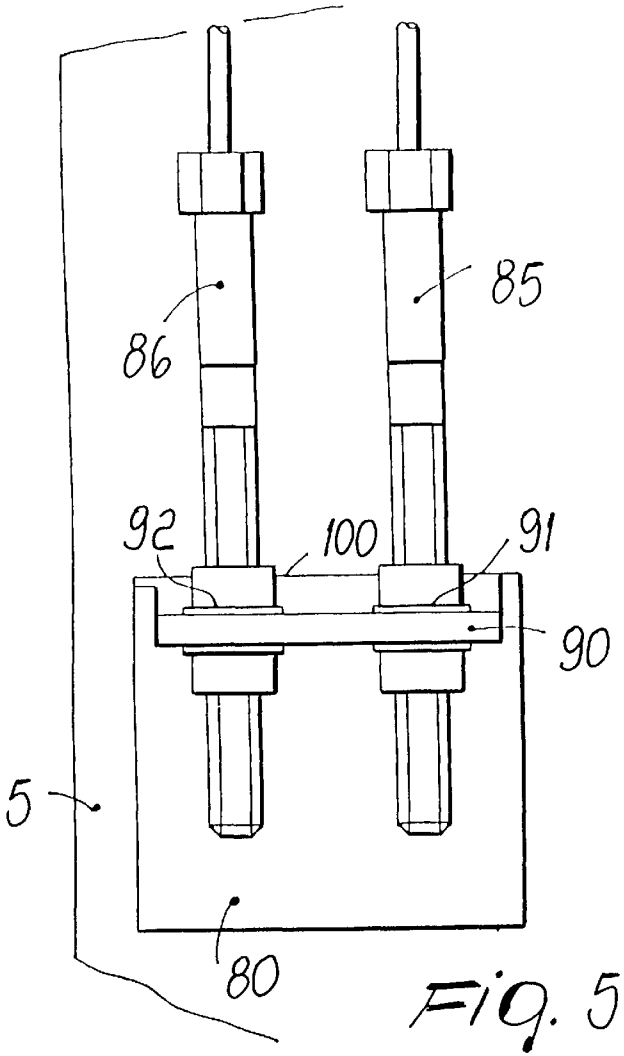

The ends of the cables 13, 17 coming from the rockers 7, 9 of other switches, 1 3 are connected to the translating slide 80 (FIGS. 2 and 5).

A projection 81 present on the plate 5 fixes the sheaths 50 by arranging the terminal parts 85, 86 of the cables 13, 17 parallel to one another.

The terminal parts 85, 86 have threads. The terminal parts 85, 86 are connected to a projection 90 present on the translating slide 80, by means of threaded holes 91, 92.

The translating slide 83 is connected to the toggles of the actuation means, through a slot 100 made in the plate 5.

The functioning of the present invention will now be described with the help of FIGS. 6, 7, 8 and 9.

Initially, when all three switches 1, 2, 3 are in the open position, the rocker 8 is balanced pulled from above by the spring 10 and from below by the cables 15, 16.

In this arrangement, the lever 60 of the rocker 8 is arranged in the upper part of the slot 70 and is not in contact with the toggles 71 of the locking means.

Figure 6:
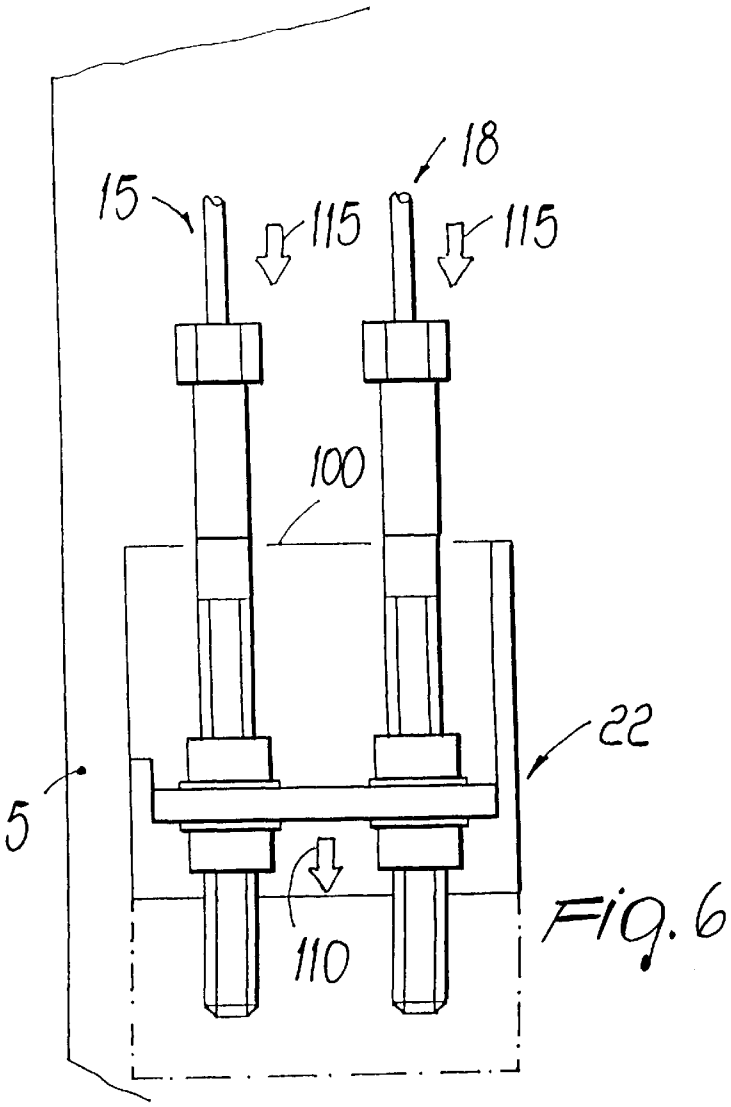
FIGS. 5 and 6 show two positions of a translating slide connected to the means of actuation of a switch.

When, for example, only the first switch 1 closes, the translating slide 22 is lowered 110 pulling 115 the cables 15, 18 (FIG. 6). Pulling 115 the cable 15, the rocker 8 pivots 116 in the anticlockwise direction (FIG. 7). The lever 60 of the rocker 8 is lowered running in the slot 70 without coming into contact with the lever 71 of the locking means. The lever 60 of the rocker 8 does not come into contact with the lever 71 of the locking means also because the terminal part 63 of the lever 60 has its lateral lips 64, 65 raised.

In the case, on the other hand, in which only the third switch 3 closes, the translating slide 24 stretches 120 the cables 16, 14, causing the rocker 8 to pivot 121 in the clockwise direction (FIGS. 1 and 8).

In the event that the first switch 1 and also the third switch 3 close, the means of actuation of the switches 1, 3 will lower the translating slides 22, 24 pulling 125, 126 the cables 15, 16, 18, 14 (FIG. 9). The cables 15, 16 are parallel to each other and equidistant from the hole 33 where the rocker 8 is elastically supported. On account of the lowering of the cables 15, 16 the rocker translates 127 downwards while remaining horizontal. The movement 127 carries the lever 60 into contact with the toggles 71 of the locking means and brings about a lowering 128 of these toggles 71.

The lowering 128 of the toggles 71 of the locking means prevents the closure of the second switch 2.

In an entirely similar manner it is possible to effect the locking of the first switch 1 in the event that the second and the third switch 2, 3 close, as also the locking of the third switch 3 in the event that the first and the second switch 1, 2 close.

Advantageously, by virtue of the threaded terminals 40, 41, 85, 86 of the cables 13, 14, 15, 16, 17, 18 and the threads of the connections present on the translating slides 80 and on the means of fixing to the rockers 7, 8, 9 it is possible to adjust the interlock devices 4. The adjustment acts on the tension of the cables 42, 43 and consequently on the pretensioning of the springs 10 as well as on the position of balance of the rockers 7, 8, 9.

For example, by screwing the terminals into the threaded holes present on the projections of the translating slides 22, 24 of the first switch 1 and of the third switch 3, it is possible to lower the rocker 8, by adjusting the position of the lever 60 inserted into the slot 70 of the plate 5.

The adjustment is carried out in a manner appropriate for preventing the rocker 8 from interacting with the toggles 71 of the locking means, pivoting only through the closing of a switch 1, 3. However, at the same time the adjustment of the position of the rocker 8 in the slot 70 is carried out in such a way that when both switches 1, 3 close, the thrust of the lever 60 of the rocker 8 is sufficient to actuate the means of locking of the switch 2.

Advantageously the use of flexible cabling to transmit the motion from the actuation means to the locking means, makes it possible to arrange the switches in any mutual position whatsoever, facilitating the design of the electrical board.

What is claimed is:

1. Set of switches with mutual locking devices, comprising a first, a second and a third switch in which each of the switches has actuation means connected via cables to locking means, wherein each of the switches has an elastically supported rocker; wherein each of the rockers is operationally connected to the looking means of a corresponding one of the switches; wherein each of the switches has an actuation means connected to two ends of two of said cables; wherein free ends of said cables of the first switch extend to an arm of the rocker of the second switch and to an arm of the rocker of the third switch; wherein free ends of said cables of the second switch extend to an arm of the rocker of the first switch and to another arm of the rocker of the third switch; and wherein free ends of said cables of the third switch extend to another arm of the rocker of the second switch and to another arm of the rocker of the first switch.

2. Set of switches according to claim 1, wherein, for each of the switches, the rockers are connected centrally to a spring fixed, at an opposite end thereof to the switch.

3. Set of switches according to claim 2, wherein the rockers have central holes to which the springs are connected.

4. Set of switches according to claim 1, wherein the actuation means of each of the switches are in operational connection with slides translating from a switch open position to a switch closed position, the translating slides being connected to said cables, said cables being Bowden type cables.

5. Set of switches according to claim 4, wherein the translating slides have a projection into which threaded terminals fixed to ends of the cables are screwed with adjustment.

6. Set of switches according to claim 4, wherein projections of a support plate to which are connected sheaths in which the cables run are provided opposite the translating slides and wherein the cables are arranged parallel to a direction of run of the translating slides.

7. Set of switches according to claim 1, wherein the rockers are provided with levers inserted freely into slots for access to toggles of the locking means provided in support plates of said rockers.

8. Set of switches according to claim 7, wherein the levers of the rockers have grooves in a terminal part thereof.

9. Set of switches according to claim 8, wherein said terminal part of each of the levers has inclined lips.

10. Set of switches according to claim 7, wherein the cables, being Bowden cables, connected to the arms of the rockers are arranged parallel to the slots for access to the toggles of the locking means.

11. Set of switches according to claim 1, wherein holes are provided at end portions of the arms of the rockers.

12. Set of switches according to claim 1, wherein said cables are flexible and run in sheaths and have threaded terminals at ends thereof.

13. Set of switches according to claim 12, wherein the threaded terminals of the cables are screwed with adjustment to the arms of the rockers by means of clasps fixed to threaded nuts.

* * * * *